US008779977B2

(12) United States Patent
Zhou

(10) Patent No.: US 8,779,977 B2
(45) Date of Patent: Jul. 15, 2014

(54) ELECTRO OPTICAL SCANNING PHASED ARRAY ANTENNA FOR PULSED OPERATION

(75) Inventor: Weimin Zhou, Rockville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/819,228

(22) Filed: Jun. 26, 2007

(65) Prior Publication Data

US 2009/0002236 A1 Jan. 1, 2009

(51) Int. Cl.
*H01Q 3/12* (2006.01)
*H01Q 3/22* (2006.01)

(52) U.S. Cl.
USPC ..... 342/368; 342/374; 342/375

(58) Field of Classification Search
USPC ..... 342/368, 372, 374, 375; 398/106, 161, 398/185, 198
See application file for complete search history.

(56) References Cited

U.S. PATENT DOCUMENTS

| | | | | |
|---|---|---|---|---|
| 5,710,651 | A * | 1/1998 | Logan, Jr. | 398/168 |
| 5,723,856 | A * | 3/1998 | Yao et al. | 250/227.11 |
| 6,690,325 | B1 | 2/2004 | Zhou | |
| 7,239,809 | B2 * | 7/2007 | Pescod | 398/87 |
| 2007/0280704 | A1 * | 12/2007 | Fitzgerald et al. | 398/198 |

* cited by examiner

*Primary Examiner* — Dao L Phan
(74) *Attorney, Agent, or Firm* — Edward L. Stolarun; Alan I. Kalb

(57) ABSTRACT

An electro optical scanning phased array antenna having a laser which generates a pulsed output. A microwave source has an output which amplitude modulates the optical output from the laser through an optical modulator. An optical loop circuit has an input connected to an output from the optical modulator and a variable time delay element. The optical loop circuit generates a plurality of modulated optical pulses at equidistantly spaced time intervals from each other at an output from the loop circuit. These time intervals vary as a function of the variable time delay element and a control circuit controls the time delay attributable to the variable time delay element. An antenna array includes end elements while a circuit converts the optical output pulses from the optical loop circuit to radio frequency signals electrically connected to the elements of the antenna array.

5 Claims, 7 Drawing Sheets

ELECTRO OPTICAL SCANNING PHASED ARRAY ANTENNA FOR PULSED OPERATION

GOVERNMENT INTEREST

The invention described herein may be manufactured, used, and licensed by or for the United States Government.

FIELD OF THE INVENTION

The present invention relates generally to scanning antennas and, more particularly, to a high frequency electro optical scanning antenna.

BACKGROUND OF THE INVENTION

High frequency radio frequency (RF) communication and radar systems typically use a phased antenna array to control the direction of the electromagnetic transmission. Phased array antennas are inherently narrow band antennas in which the scan angle varies as a function of the true time delay or phase delay between the microwave radiation from each adjacent antenna element.

In order to control the beam direction of the transmission, the previously known scanning antennas have utilized feed networks that vary either the phase or time delay between the feed point for the antenna and the individual antenna array elements. A broadside or undeflected beam occurs when the input signal reaches the individual antenna array elements at the same time and phase. In practice, the beam direction can be varied ±θ degrees off center from the broadside direction by varying the phase or time delay of the signal to the individual antenna elements.

In order to control the direction of the beam transmission from the antenna, many of the previously known antenna arrays have utilized variable phase networks wherein one network is connected between the signal input to the antenna array and each antenna element. These previously known antennas, however, have not proven wholly satisfactory in operation.

One disadvantage of utilizing variable phase networks to control the beam direction for the phased antenna array is that the variable phase networks are expensive and this expense increases dramatically as the number of antenna elements increases.

A still further disadvantage of these previously known variable phase networks is that the previously known systems have utilized switches to selectively connect transmission line segments between the signal input to the antenna and the various antenna elements. Since each transmission line section introduces a preset time delay or phase shift to its associated antenna element, the deflection of the beam from the broadside beam direction is limited to a number of discrete angles relative to the broadside beam direction. Furthermore, signal losses associated with these switches are unacceptable for many high frequency applications, i.e. applications where the wavelength is in the millimeter range, such as 35 gigahertz.

A still further disadvantage of these previously known variable phase networks is that the circuitry necessary to effect the variable phase, particularly when a high number of antenna elements is involved, is necessarily bulky in construction. In many applications, for example when the antenna is used in an aircraft, the space requirements for these previously known systems exceed the available space limitations of the aircraft. This, in turn, necessitates undesirable compromises in the utilization of the available aircraft space.

SUMMARY OF THE INVENTION

The present invention provides an electro optical scanning antenna which overcomes all of the above disadvantages of the previously known scanning antennas.

In brief, the scanning antenna of the present invention comprises an antenna array having a plurality of antenna elements. These antenna elements are aligned linearly relative to each other so that the antenna elements are equidistantly spaced from each other.

In order to provide the timing signals necessary to properly activate the antenna elements, a pulsed laser, such as a tunable CW laser combined with an optical switch or modulator, produces a pulsed optical output signal to the input of an external optical modulator. The optical pulse is then modulated by a high frequency RF signal to produce RF modulated output optical pulses on the output from the modulator.

The output pulses from the optical modulator are, in turn, coupled as an input signal to a 2×2 optical coupler which is connected to an optical loop circuit. The loop circuit includes a variable time delay element, an optical amplifier and other optical components that help to reduce the noise circulation in the loop, so that, upon receipt of an RF modulated optical pulse from the optical modulator, the optical loop circuit regenerates a plurality of modulated optical output pulses at equidistantly spaced time intervals from each other. The time spacing of the pulses from the optical loop circuit, however, will vary as a function of the variable time delay element.

In one embodiment of the invention, the laser is a variable wavelength tunable laser while the variable time delay element in the optical loop circuit comprises a wavelength-dependent time delay element. Consequently, the time interval between output pulses from the optical loop circuit varies as a function of the laser wavelength.

In yet another embodiment the laser comprises a fixed wavelength laser and the variable time delay element in the optical loop circuit comprises an electro-optical waveguide device in which the index may be varied by changing the bias applied to the waveguide device. Consequently, the time interval between output pulses from the optical loop circuit varies as a function of the bias applied to the electro-optical waveguide device.

The optical pulses from the loop circuit are then utilized to activate the antenna elements in a transmission mode or receiving mode. In one embodiment, a plurality of 1×2 optical switches are coupled in series with the output signal from the optical loop circuit. A second output from each optical switch is then connected through a photodetector and RF amplifier to its associated antenna element. Consequently, in operation, after the loop circuit has regenerated a number of pulses at least equal to the number of antenna elements, the optical switches are switched to their second position thus diverting the regenerated optical pulses from the loop circuit to the antenna elements through the photodetector and RF amplifier thus activating the antenna elements in the desired fashion. The timing of the activation of the individual antenna elements, however, is controllable by varying the frequency or wavelength of the tunable laser and, by doing so, varies the beam deflection of the radiated signal.

In still other embodiments of the invention, for a receiving mode configuration, the received RF microwave pulsed signals from the antenna elements are combined by 2×1 RF combiners which are connected in series with each other between the antenna elements through RF cable delays to produce the received pulse train that is synchronized with the output local oscillator pulse signal train produced from the optical loop circuit through a photodetector and then an RF phase shifter. Each RF cable delay introduces the same time delay between the adjacent antenna elements so that it matches the fixed time delay produced by the optical loop, so that the received RF pulse train can be synchronized with the reference local oscillator pulse train produced by the optical loop. The pulse train pairs are then mixed using an RF mixer and the output signal from the mixer goes to conventional RF signal processing systems.

BRIEF DESCRIPTION OF THE DRAWINGS

The present invention will be better understood upon reference to the following detailed description when read in conjunction with the accompanying drawing wherein like reference numerals refer to like parts throughout the several views, and in which.

DESCRIPTION OF THE PREFERRED EMBODIMENTS

Figure 1:
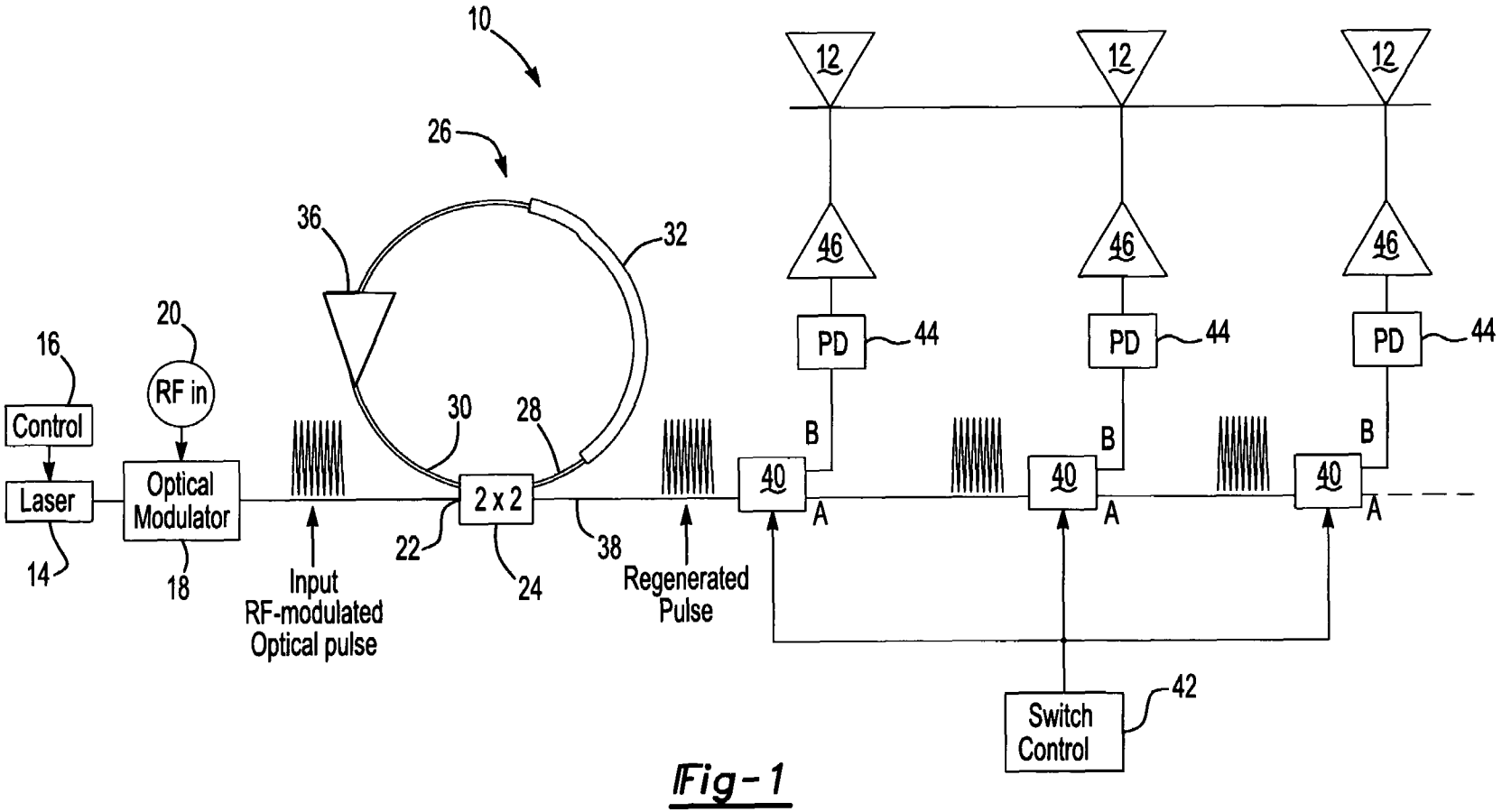
FIG. 1 is a diagrammatic view illustrating a first embodiment of the present invention.

With reference first to FIG. 1, a block diagrammatic view of a first embodiment of an electro optical scanning antenna array 10 of the present invention is shown having a plurality N of antenna elements 12. The antenna elements 12 are linearly aligned with each other and are preferably equidistantly spaced from each other. Although the antenna array 10 illustrated in FIG. 1 shows only three antenna elements 12, it will be understood that fewer or more antenna elements 12 may be utilized in the antenna array 10 without deviation from the spirit or scope of the invention.

Still referring to FIG. 1, the scanning antenna array 10 includes a laser 14, which generates a pulsed output. The laser 14 may be a pulsed laser or a continuous wave diode laser combined with a square function optical switch or modulator.

The laser 14 has its output optically coupled to an external optical amplitude modulator 18. The modulator 18 receives an input signal from a microwave frequency source 20, e.g. 35 gigahertz, to modulate the output light pulse from the laser. Alternatively, however, the laser 14 may be directly amplitude modulated or externally modulated by the microwave source 20 first, then gated by the square function switch or modulator to produce the RF modulated optical pulse.

The modulated optical signal from the laser 14 is then optically coupled to one input 22 of a 2×2 optical fiber coupler 24. An optical loop circuit 26 is then optically connected between an output 28 of the coupler 24 and the other input 30 of the coupler 24. This optical circuit 26, furthermore, includes a variable time delay element 32, as well as fixed time delay elements made by the optical fibers connecting all the components in the loop. The optical loop circuit 26 also preferably includes an optical amplifier 36 along with an optical device 37 that cleans the optical noise and regulates the polarization in the loop.

In one embodiment of the invention, the laser 14 is a variable wavelength tunable laser while the variable time delay element 32 in the optical loop circuit comprises a wavelength-dependent time delay element such as a photonic band gap wave guide or an optical fiber grating used in the transmission mode. Consequently, the time interval between output pulses from the optical loop circuit varies as a function of the laser wavelength. A control circuit 16 controls the operation of the laser to continuously vary the wavelength of the laser 14 within predetermined limits and thus the time interval between consecutive output pulses from the optical loop circuit 26.

Figure 7:
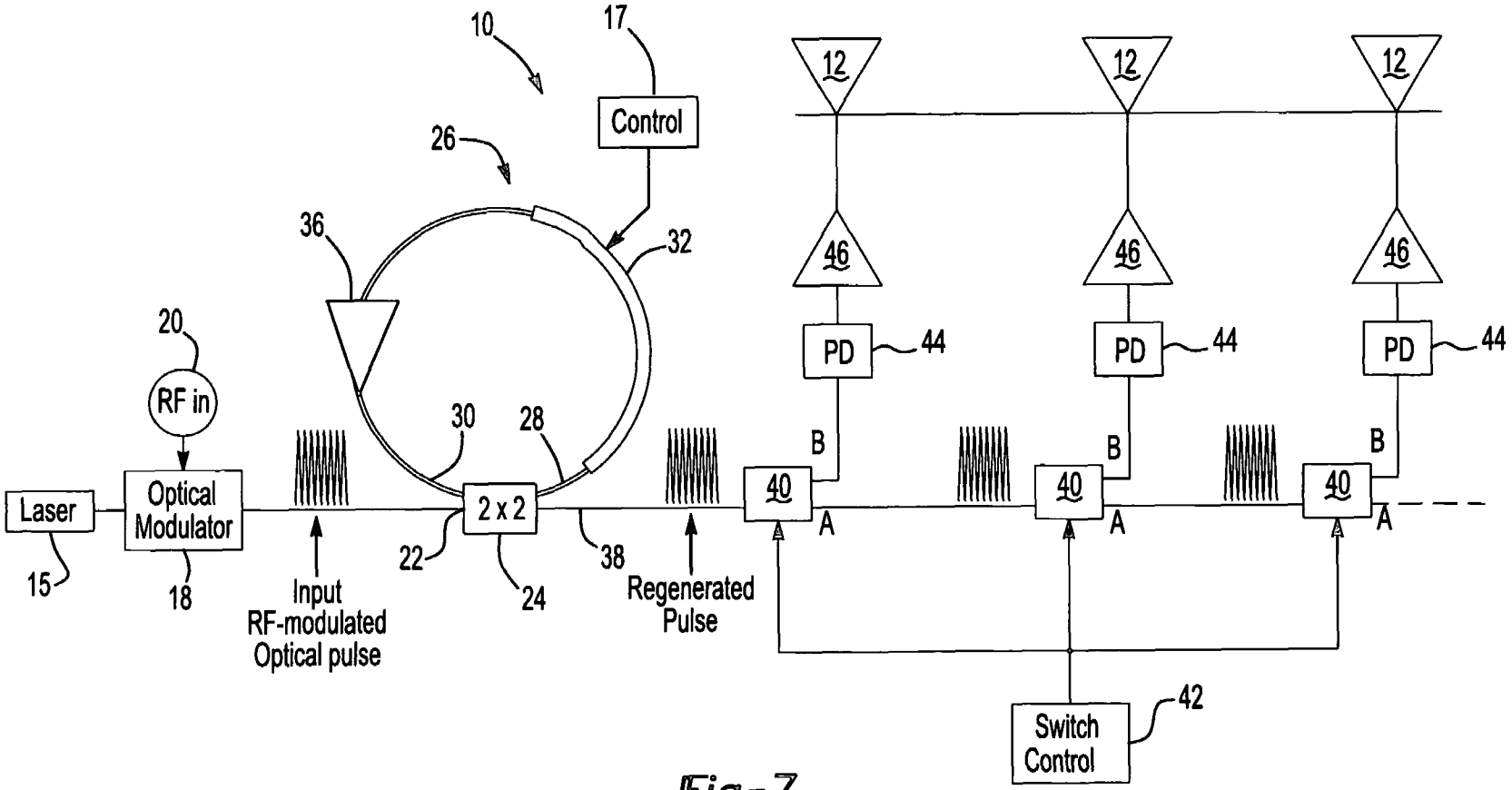
FIG. 7 is a view similar to FIG. 1 but illustrating an alternate embodiment and with parts removed.

In yet another embodiment illustrated in FIG. 7 the laser comprises a fixed wavelength laser 15 and the variable time delay element 32 in the optical loop circuit comprises an electro-optical waveguide device in which the index may be varied by changing the bias applied to the waveguide device. Consequently, the time interval between output pulses from the optical loop circuit varies as a function of the bias applied to the electro-optical waveguide device. A control circuit 17 controls the bias applied to the variable time delay element 32 and thus the time interval between consecutive output pulses from the optical loop circuit 26.

The remaining embodiments of the invention will be described as having a variable wavelength tunable laser 14 and a wavelength-dependent time delay element 32 as the variable time delay element 32 in the optical loop circuit 26. It will be understood, however, that other types of variable time delay elements 32, such as an electro-optical waveguide device with an index which varies as a function of the applied bias, may be utilized without deviating from the spirit or scope of the invention.

Referring again to FIG. 1, upon receipt of an RF modulated optical pulse from the optical modulator 18, the optical loop circuit 26 generates a series of optical pulses on a second outlet 38 from the coupler 24. These optical pulses on the coupler outlet 38, furthermore, are equidistantly spaced in time from each other in an amount determined by the wavelength of the laser 14 due to the variable time delay device 32. Furthermore, the number of pulses regenerated by the optical loop circuit 26 in response to an input optical pulse from the optical modulator 18 comprises at least the number N, i.e. the number of antenna elements 12.

Still referring to FIG. 1, the scanning antenna array 10 includes a plurality of 1×2 optical switches 40 which are optically connected in series with each other so that one output from each optical switch is connected as an input to the next downstream optical switch. Furthermore, one optical switch 40 is associated with each antenna element 12 except optionally for the last antenna element 12 furthest downstream from the optical loop circuit 26 which can be connected directly with the output to the optical switch 40 associated with the preceding antenna element 12. Consequently, the antenna array includes at least N−1 optical switches. Furthermore, the operation of the optical switches 40 is controlled by a switch control circuit 42.

The second or other output from each optical switch 40 is connected as an input signal to a photodetector 44 associated with the particular antenna element 12. The photodetector 44 converts the light signal and produces a radio frequency (RF) signal on its output. This RF signal is coupled through an RF amplifier 46 to its associated antenna element 12. It will, of course, be understood that one photodetector 44 and one RF amplifier 46 is associated with each antenna element 12.

In operation, the laser control circuit 16 adjusts the wavelength of the laser 14 to achieve the desired beam deflection. The output from the laser 14 is then modulated by the optical modulator 18 to produce an RF modulated optical pulse on the output from the modulator. This pulse is then coupled as an input signal to the optical loop circuit 26 through the coupler 24.

Upon receipt of the optical pulse from the modulator 18, the optical loop circuit 26 generates a series of optical pulses on the second output 38 from the optical coupler 24 and in which the time delays for the pulses are equal to $\tau\pm\Delta t$, $2(\tau\pm\Delta t)$, $3(\tau\pm\Delta t)$, . . . $n(\tau\pm\Delta t)$ where $\tau$ equals the time delay introduced by the fixed time delay for the light at a center wavelength travel one revolution in the optical loop circuit 26, $\Delta t$ equals the change in time delay introduced by the variable time delay device 32 as the wavelength of the laser changes, and n equals the number of antenna elements 12.

During the generation of the pulse train by the optical loop circuit 26, the switch control 42 maintains the optical switches 40 in a first position in which the pulse train passes directly from each optical switch 40 to the input of the next downstream optical switch 40 or, for the last antenna element 12, directly to that antenna element 12. Furthermore, the optical path between not only the first optical switch 40 and the optical coupler 24, but also between each adjacent pair of optical switches 40, are not only equal, but are dimensioned to substantially equal the optical round trip path in the optical loop 26 that introduced the fixed time delay $\tau$.

After a pulse train has been regenerated by the optical loop circuit 26 equaling at least the number of pulses corresponding to the number N of antenna elements 12, the switch control 42 activates all of the switches 40 simultaneously to switch the switches 40 to a second position. In doing so, the optical pulses are diverted to the photodetector 44 associated with each optical switch 40 which, in turn, activates the antenna element 12 through its associated RF amplifier 46. Since the time delay interposed by the optical connection between adjacent optical switches effectively cancels the optical delay introduced by the fixed time delay $\tau$ in the optical loop circuit 26, the antenna elements 12 will be activated at a time period determined by $\Delta t$ thus steering the radiated beam in the desired fashion. Since $\Delta t$ is determined by the variable time delay device 32 which varies as a function of the laser wavelength, the beam steering can be achieved continuously within the limits of the antenna array by merely controlling the laser wavelength by the control circuit 16.

Figure 2:
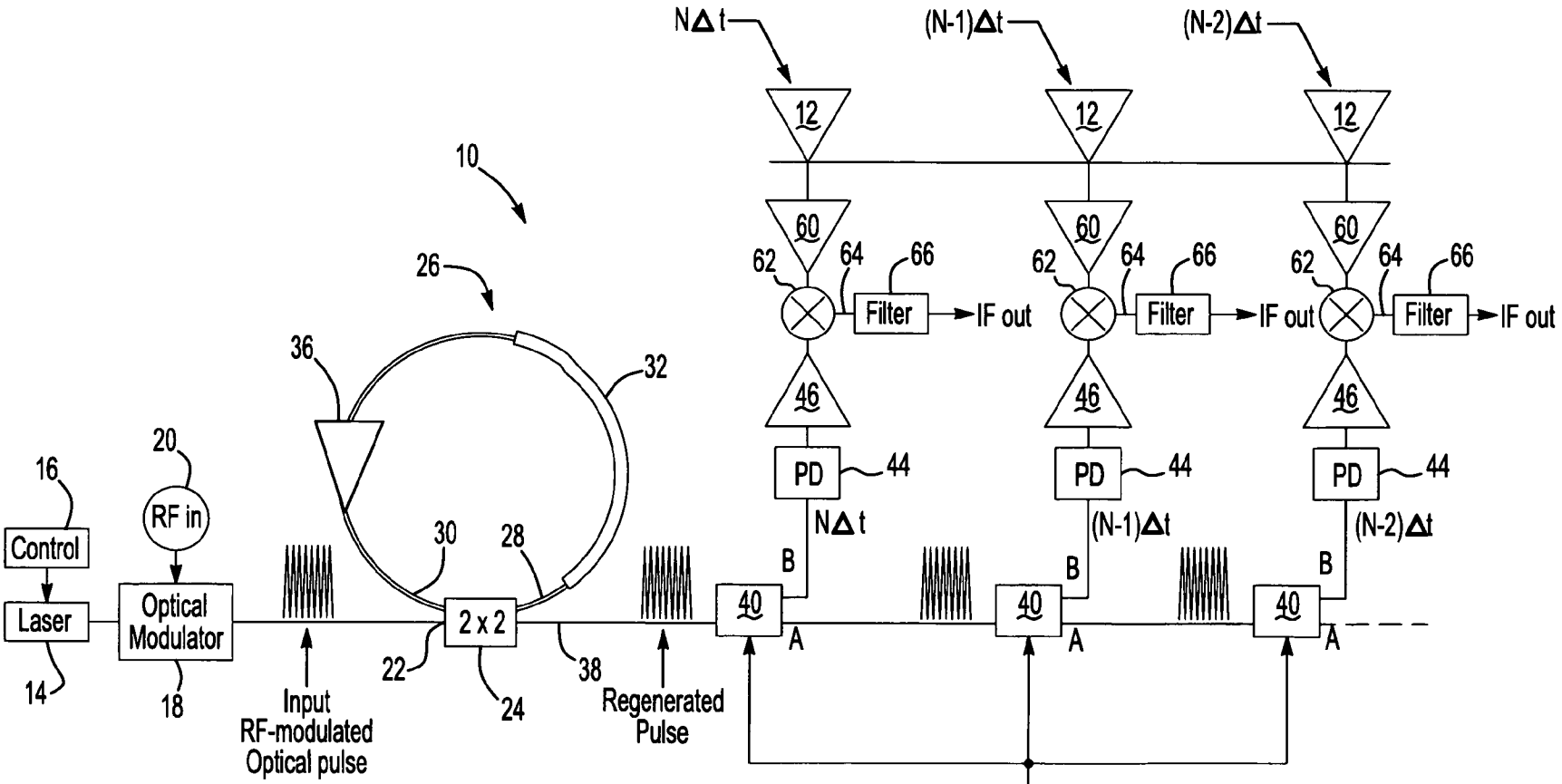
FIG. 2 is a diagrammatic view illustrating a second embodiment of the present invention.

The antenna 10 illustrated in FIG. 1 illustrates the operation of the antenna 10 in a transmission mode. With reference now to FIG. 2, the operation of the antenna will be illustrated in a receive mode. Furthermore, it will be understood that like reference characters in FIGS. 1 and 2 correspond to these same elements and that a further description of these elements is not required.

With reference then to FIG. 2, with the antenna 10 in a receive mode, each antenna element 12 is coupled to an RF amplifier 60 having its output connected to an RF mixer 62. The received RF signal through the output from the RF amplifier 46 for each antenna element 12 is mixed at the mixer 62 with the reference local oscillator RF signal produced by the optical delay loop system connected to a second input of the RF mixer 62. An output 64 from the RF mixer 62 is then coupled through a filter 66 thus forming an intermediate frequency output from the antenna element 12. It will, of course, be understood that one RF mixer 62 is associated with each antenna element 12. All of the intermediate frequency output from the filters 66 are then constructively combined and processed in the conventional fashion.

In operation, the output signals from the RF amplifiers 46 to the mixer 62 vary between adjacent antenna elements 12 by the time $\Delta t$ as previously described. Consequently, since these output signals are provided to the RF mixer 62, the output signals from the RF mixer 62 are synchronized in the desired fashion as a function of beam deflection.

Figure 3:
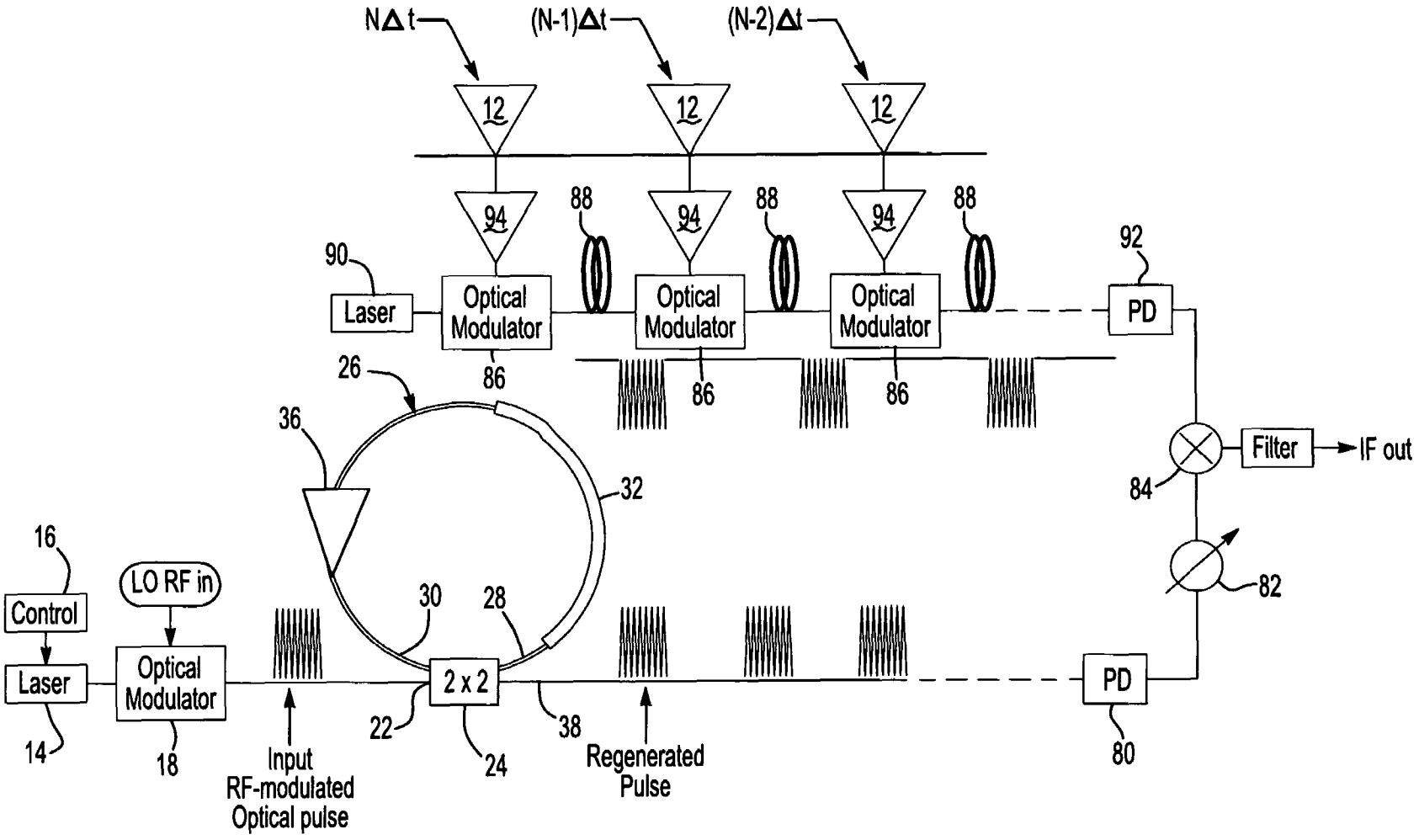
FIG. 3 is a diagrammatic view illustrating a third embodiment of the present invention.

With reference now to FIG. 3, a still further embodiment of the present invention is shown in a signal reception mode. Unlike the previous embodiments of the invention, the second output 38 from the coupler 24, i.e. the output on which the pulse train from the optical loop circuit 26 is produced, is coupled directly as an input signal to a photodetector 80. This photodetector 80 converts the light to an RF signal which is coupled to an RF mixer 84 via an RF phase shifter 82.

An optical modulator 86 is associated with each antenna element 12. These optical modulators 86 are coupled in series with each other through a fixed length optical fiber 88 dimensioned to be equal to the time delay interposed by the fixed time delay in the optical loop 26. A fixed frequency laser 90 is coupled as an input signal to one end of the series of optical modulators 86 while the other end of the optical modulators 86 is coupled as an input signal to a photodetector 92. The output from the photodetector 92 is coupled as an input signal to the RF mixer 84.

Each antenna element 12 is coupled through an RF amplifier 94 to the optical modulator 86 associated with the antenna element 12 so that the received RF signal from each element 12 RF modulates the optical signal from the laser 90. In doing so, the optical modulators produce a pulse train to the photodetector 92 corresponding to the signal received by the antenna elements 12.

Since the optical pulse train from the optical loop circuit 26 varies in time delay depending upon the wavelength of the laser 14 and thus the beam deflection, the combination of the signals from the photodetector 80 effectively synchronize the received signals from the antenna elements 12 and provide the combined signals to an RF filter which selects the desired IF output signal from the RF mixer 84. The output signal from the RF mixer 84 and filter combination is then processed using standard RF processing circuitry.

Figure 4:
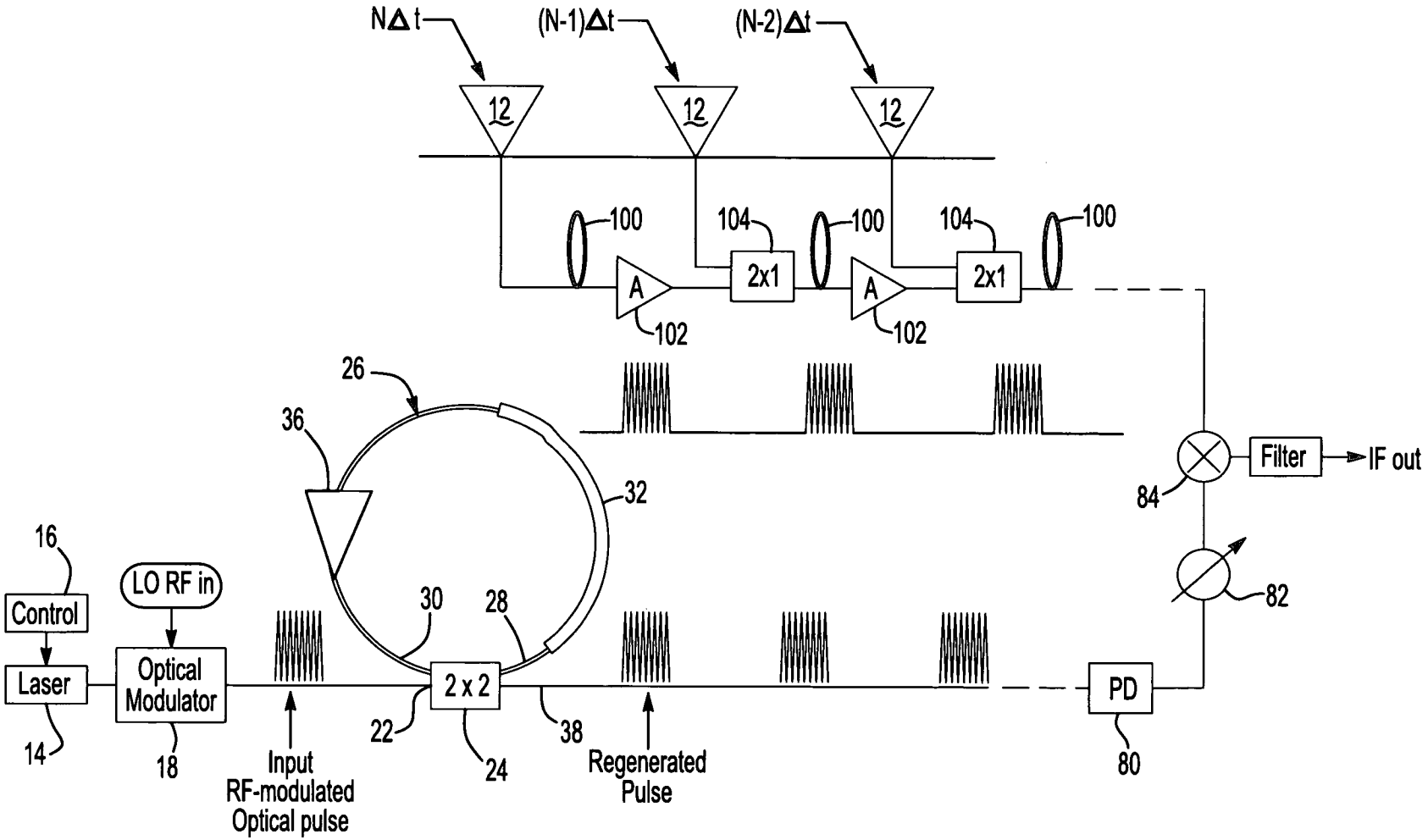
FIG. 4 is a diagrammatic view illustrating a fourth embodiment of the invention.

With reference now to FIG. 4, a still further embodiment of the present invention is shown which is similar to the FIG. 3 embodiment, except that the received signals from the antenna elements 12 are directly processed in the RF domain, rather than the optical domain. More specifically, each antenna element 12 is coupled through an RF cable delay 100 to an input signal to an RF amplifier 102. The time delay from each cable delay 100 and amplifier 102, furthermore, is dimensioned to compensate for the fixed time delay introduced by the fixed time delay in the optical loop circuit 26.

The output signals from the RF amplifiers 102 are combined together using standard RF combiners 104 and the pulse train from the antenna elements 12 is coupled as an input signal to the mixer 84. This signal, as before, is then synchronized by the pulse train from the photodetector 80 thus effectively steering the antenna array 10 in the desired fashion.

Figure 5:
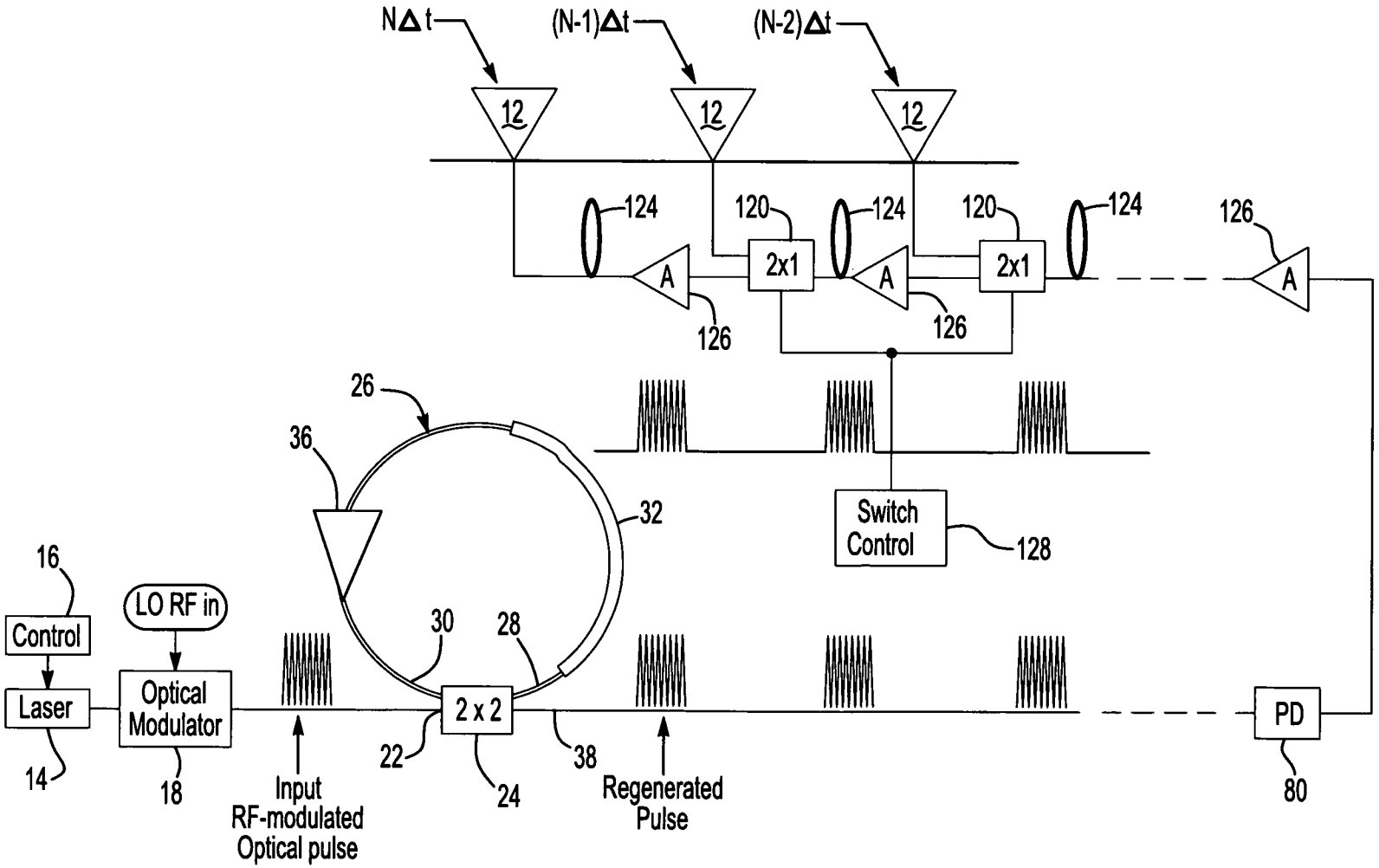
FIG. 5 is a diagrammatic view illustrating a fifth embodiment of the present invention.

With reference now to FIG. 5, a further embodiment of the invention is shown which corresponds to the FIG. 4 embodiment, except that the operation of the invention is illustrated in the transmission mode. More specifically, the output signals from the photodetector 80, as before, are synchronized in time by an amount depending on the laser wavelength 14 and thus the desired beam deflection.

At least N−1 1×2 RF switches 120 are connected in series with each other through an RF cable delay 124. The RF cable delay 124 is dimensioned to introduce a time delay in the RF signal equal to the time delay introduced by the fixed time delay of the optical loop circuit 26. Appropriate RF amplifiers 126 are also provided, as required, before, between and after the RF switches 120 to amplify the RF signal as required.

The other output from the RF switches 120 is connected to one of the antenna elements 12, except for the last antenna element 12' for which no switch is required, so that one RF switch 120 is associated with each antenna element 12 except for the last element 12'.

In operation, the optical loop circuit 26 generates a plurality of optical pulses to the photodetector 80 having a time delay dependent upon the wavelength of the laser 14. The photodetector 80, as before, converts these optical pulses into RF pulses which are, in turn, coupled to the series of RF switches 120 through the RF amplifiers 126.

During a number of pulses corresponding to the number N of the antenna elements 12, a switch control 128 maintains the switches 120 in a first position so that the RF pulse train is propagated along the switches 120. Once the number of pulses corresponding to the number of antenna elements 12 have been generated, the RF switch control 128 simultaneously switches the RF switches 120 to their second position thus connecting the RF pulse to the antenna element 12 associated with the RF switch 20 thus activating or energizing the antenna elements 12 in the desired fashion and with a time delay determined by the frequency of the laser 14.

Figure 6:
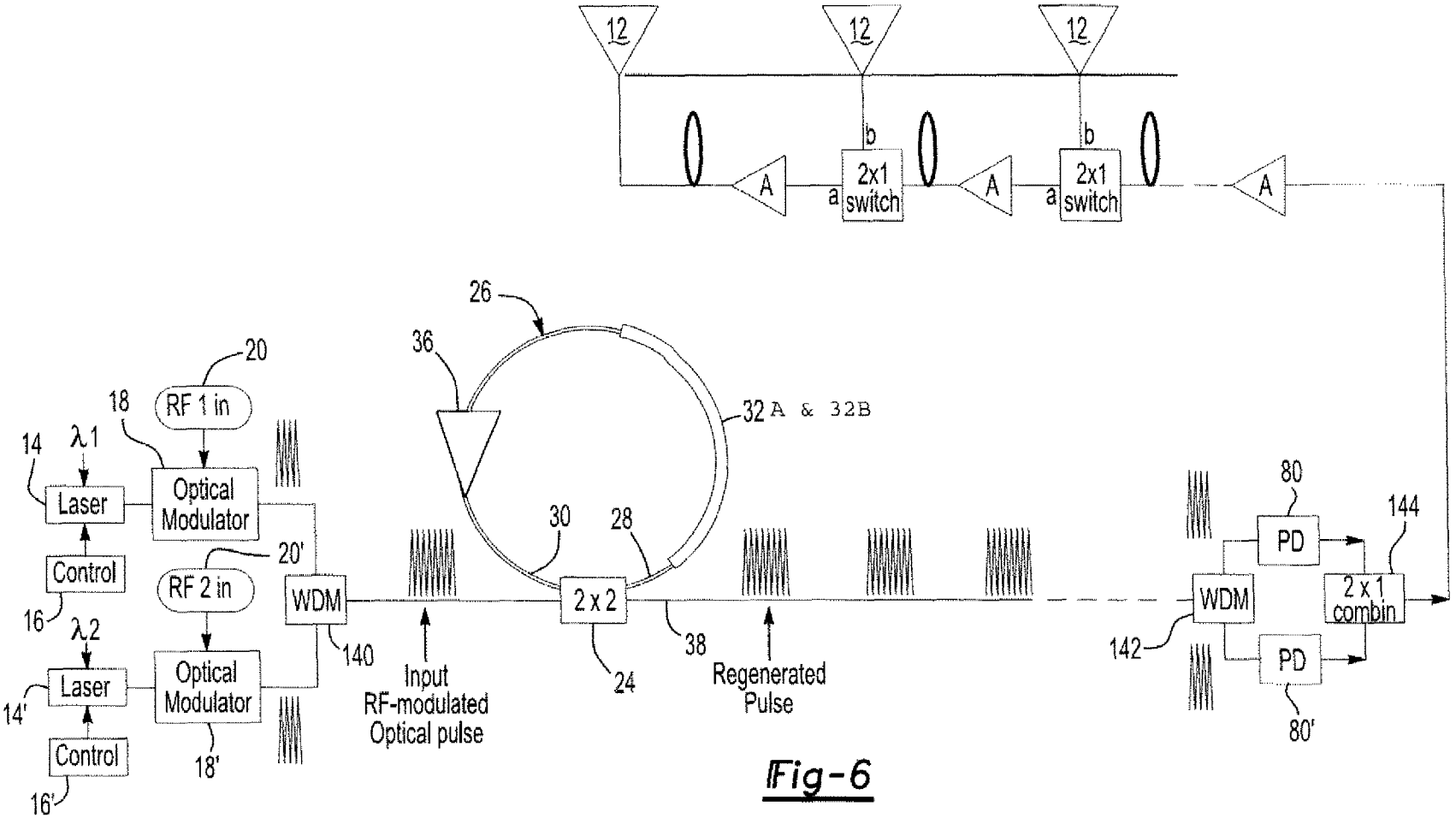
FIG. 6 is a diagrammatic view illustrating a sixth embodiment of the present invention.

With reference now to FIG. 6, a still further embodiment of the present invention is shown which corresponds to the FIG. 5 embodiment except that it includes a second laser 14' having a wavelength different than the first laser 14. A control circuit 16' controls the wavelength of the second laser 14' while an optical modulator 18' modulates the laser output in accordance with a second RF generator 20'.

The outputs from the optical modulators 18 and 18' are then coupled as input signals to a wavelength division multiplex 140 which combines the output signals from the optical modulators 18 and 18' together in the conventional fashion. This combined signal is then coupled as an optical input signal to the optical loop circuit 26 which regenerates two series of optical pulses having time delays determined by two variable delay elements which are wavelength sensitive to its corresponding lasers and controlled by the control circuits 16 and 16' respectively.

The output from the optical coupler 24 is subsequently coupled as an input signal to a wavelength division multiplexer 142 which then separates the first series of pulses with a wavelength corresponding to the first laser 14 from the second series of pulses with a different wavelength corresponding from the second laser 14'. Each output from the wavelength division multiplexer 142 is then coupled as an input of the corresponding photodetector 80 or 80'. The RF outputs from the photodetectors 80 and 80' are then combined by an RF combiner 144 and this combined signal is then coupled to the antenna array in the same fashion as discussed with respect to the FIG. 5 embodiment.

Consequently, by utilizing two lasers, the same antenna array may be simultaneously and independently used with two RF beams for two purposes, e.g. radar and communications. In achieving this dual use of the antenna array, it is only necessary that the wavelength of the lasers 14 and 14' sufficiently differ from each other to avoid cross interference.

From the foregoing, it can be seen that the present invention provides an RF microwave beam forming of an electro optical scanning antenna which utilizes a single variable time delay element in order to achieve the variable Δt between each neighbored antenna elements in both the transmission and receive mode for each RF beam. A primary advantage of the present invention is that, since only a single variable time delay element is utilized in the optical loop circuit, any inaccuracy caused by the use of multiple variable time delay devices is completely avoided.

Having described my invention, however, many modifications thereto will become apparent to those skilled in the art to which it pertains without deviation from the spirit of the invention as defined by the scope of the appended claims.

I claim:

1. An electro optical scanning antenna comprising:

at least one laser;

at least one control circuit coupled to said laser; at least one optical modulator coupled to said laser; at least one radio frequency microwave source coupled to said optical modulator; an optical loop circuit coupled to said optical modulator and having at least one tunable optical time delay device, an optical amplifier coupled to said tunable optical time delay device, a fixed time delay line element connected in series to both said optical amplifier and said tunable optical time delay device, and a two by two optical coupler coupled to said optical loop circuit and said optical modulator; a time domain pulse redistribution circuit coupled to said two by two coupler and comprising a plurality of photo diodes, a plurality of radio frequency amplifiers coupled to said photo diodes, a plurality of fixed time delay lines, a plurality of optical switches coupled to said photo diodes and said fixed time delay lines, at least one control circuit in communication with said optical switches, and a plurality of antenna elements associated with said time domain pulse redistribution circuit whereby; said control circuit controls said laser in order to generate a pulsed laser output and control the wavelength of said output and said optical modulator modulates the amplitude of said optical pulse from said laser and said fixed time delay lines in said time domain pulse redistribution circuit having a time delay that is substantially equal to the time delay made by said optical loop circuit in order to distribute the series of pulses generated by the optical loop circuit and compensate for the fixed delays produced by the travel time of pulses within said loop circuit.

2. The electro optical scanning antenna of claim 1 wherein said laser is a wavelength tunable laser.

3. The electro optical scanning antenna of claim 1 wherein said tunable optical time delay device further comprises a dispersive optical fiber grating.

4. The electro optical scanning antenna of claim 1 wherein said tunable optical time delay device further comprises a photonic band gap waveguide device.

5. The electro optical scanning antenna of claim 1 wherein said tunable optical time delay device further comprises an electro optical variable time delay element.

* * * * *